US011136999B2

(12) United States Patent
Chang et al.

(10) Patent No.: US 11,136,999 B2
(45) Date of Patent: Oct. 5, 2021

(54) BALANCE STRUCTURE OF FAN WHEEL

(71) Applicant: ASIA VITAL COMPONENTS CO., LTD., New Taipei (TW)

(72) Inventors: Bor-Haw Chang, New Taipei (TW); Chung-Shu Wang, New Taipei (TW)

(73) Assignee: ASIA VITAL COMPONENTS CO., LTD, New Taipei (TW)

( * ) Notice: Subject to any disclaimer, the term of this patent is extended or adjusted under 35 U.S.C. 154(b) by 231 days.

(21) Appl. No.: 15/905,721

(22) Filed: Feb. 26, 2018

(65) Prior Publication Data

US 2019/0264708 A1 Aug. 29, 2019

(51) Int. Cl.
*F04D 29/66* (2006.01)
*F04D 29/32* (2006.01)

(52) U.S. Cl.
CPC ..... *F04D 29/662* (2013.01); *F04D 29/329* (2013.01)

(58) Field of Classification Search
CPC ..... F04D 29/329; F04D 29/28; F04D 29/62; F04D 29/66; F04D 29/661; F04D 29/662; F04D 29/668; F05B 2230/10; F05B 2230/104; F05B 2260/96; F05B 2260/964; F05B 2260/966
See application file for complete search history.

(56) References Cited

U.S. PATENT DOCUMENTS

| | | | | |
|---|---|---|---|---|
| 6,881,033 | B2 * | 4/2005 | Makinson | F04D 29/281 416/3 |
| 8,182,220 | B2 * | 5/2012 | Li | F04D 25/0613 415/229 |
| 8,708,674 | B2 * | 4/2014 | Hoffman | A61M 16/0063 417/423.15 |
| 8,721,266 | B2 * | 5/2014 | Chang | F04D 29/662 415/119 |
| 8,757,978 | B2 * | 6/2014 | Takeshita | F04D 29/662 416/185 |
| 9,017,038 | B2 * | 4/2015 | Pelley | F04D 27/004 417/44.1 |
| 10,968,921 | B2 * | 4/2021 | Cho | F04D 29/388 |
| 2007/0253820 | A1 * | 11/2007 | Liu | F04D 29/662 416/144 |
| 2013/0004348 | A1 * | 1/2013 | Sugiyama | F04D 29/057 417/423.7 |

FOREIGN PATENT DOCUMENTS

| | | |
|---|---|---|
| CN | 201433942 Y | 3/2010 |
| TW | M299230 | 10/2006 |
| TW | I439786 | 6/2014 |

* cited by examiner

*Primary Examiner* — Woody A Lee, Jr.
*Assistant Examiner* — Brian O Peters
(74) *Attorney, Agent, or Firm* — Demian K. Jackson; Jackson IPG PLLC

(57) ABSTRACT

The present invention relates to a balance structure of a fan wheel, which comprises a hub and a plurality of blades disposed on the circumferential side of the hub. The hub has a top wall connected to a sidewall. An unbalanced portion for being removed is selectively disposed on the top wall or on the sidewall. The unbalanced portion is disposed on one side of a symmetrical axis of the hub. In this way, the weight of the fan wheel is balanced.

6 Claims, 7 Drawing Sheets

BALANCE STRUCTURE OF FAN WHEEL

BACKGROUND OF THE INVENTION

Field of the Invention

The present invention relates to a balance structure of a fan wheel and, in particular, to a balance structure of a fan wheel, which achieves the effects of quick balancing of the fan wheel and reducing the working hours of balancing.

Description of Prior Art

With the development of the computer technology, the operating frequencies and the performances of the components inside the computers increase and thus the power consumption and the heat generation of components inside the computers increase accordingly. In order to reduce the temperature inside the PC case and help dissipate the generated heat, a heat-dissipating mechanism with a high performance is required to help remove the heat generated from the components inside the PC case to prevent the interior of the PC case from remaining in a high temperature state which further affects the lifetimes of the internal components or causes unstable operation. In the field of heat dissipation for the computer system, the mainstream of computer cooling technique commonly used in the industry is a combined heat-dissipating system including the fan and the heat-dissipating fin. The fan, which is an axial fan, a centrifugal fan, or a mixed flow fan, is always equipped with the heat-dissipating fin as a main choice to resolve the issue of system over-temperature or help remove the heat generated from the internal components.

The principle of wind generation by the fan is nothing more than through the shape design of the blades on the fan wheel and the drives of the motor and the circuit board to make the fan wheel rotate at the rated speed such that the air flows through the rotating designed blades to thrust to generate the wind. Besides, the rotating component (i.e., the fan wheel) achieves a smooth rotation by the calibration of a fan wheel balancing machine to prevent the undesired vibration that induces noise and affects the fan structure to decrease the lifetime of the fan. As for a traditional fan, the smaller the fan size is, the more important the vibration requirements of the fan become. When the fan is compact and lightweight, the vibration requirements of the fan are tough. Thus, the balancing process is extremely hard. Also, it is usually difficult to control an adequate amount (e.g., milligrams) of balancing clay and the balancing process needs to be repeated to converge to meet the requirements. Therefore, the balancing process of calibrating the fan wheel takes much more time to obtain a better balancing quality. Besides, more work force and balancing equipment are required to maintain a substantial capacity, which causes higher production cost and excessive working hours for the balancing.

The current operation of the balancing and calibration process regarding the fan wheel is still performed manually. The workers perform manual weight addition (i.e., balance by compensation) or manual weight reduction (i.e., balance by reduction) according to the approximate test result and the position of an unbalance point projected by a light on the fan wheel. For example, the worker looks at the approximate position of the unbalance point projected on the fan wheel and then takes the whole fan wheel out and away from the fan wheel balancing machine for balance compensation. At this time, the position of the unbalance point projected previously on the fan wheel does not exist any longer and only can be recognized by the worker's sight and memory for adding weight or reducing weight of the fan wheel. Therefore, the completion of the balancing and calibration process regarding the fan wheel needs repeated tests and weight addition/reduction processes. As a result, the production yield rate decreases and the balancing accuracy is not high.

SUMMARY OF THE INVENTION

One objective of the present invention is to provide a balance structure of a fan wheel, which achieves quick balancing of the fan wheel.

Another objective of the present invention is to provide a balance structure of a fan rotor, which effectively reduces the number of balancing repetition and decreases the working hours for the balancing process by means of an unbalanced portion for being removed. The unbalanced portion is integrally formed and selectively disposed on the top wall or on the sidewall of the hub and disposed on one side of a symmetrical axis of the hub such that the accurate weight of the whole unbalanced portion can be removed to balance the fan wheel.

Another objective of the present invention is to provide a balance structure of a fan wheel, which decreases the work force to effectively reduce the production cost.

To achieve the above objectives, the present invention provides a balance structure of a fan wheel, which comprises a hub and a plurality of blades disposed on the circumferential side of the hub. The hub has a top wall connected to a sidewall. An unbalanced portion for being removed is selectively disposed on the top wall or on the sidewall. The unbalanced portion is disposed on one side of a symmetrical axis of the hub such that the weight of the fan wheel is balanced. By means of the design of the balance structure of the present invention, the production cost and the working hours can be effectively reduced and the effect of quick balancing of the fan rotor can be achieved.

DETAILED DESCRIPTION OF THE INVENTION

The above objectives, structural and functional characteristics of the present invention will be described according to the preferred embodiments with the accompanying figures.

Figure 1:
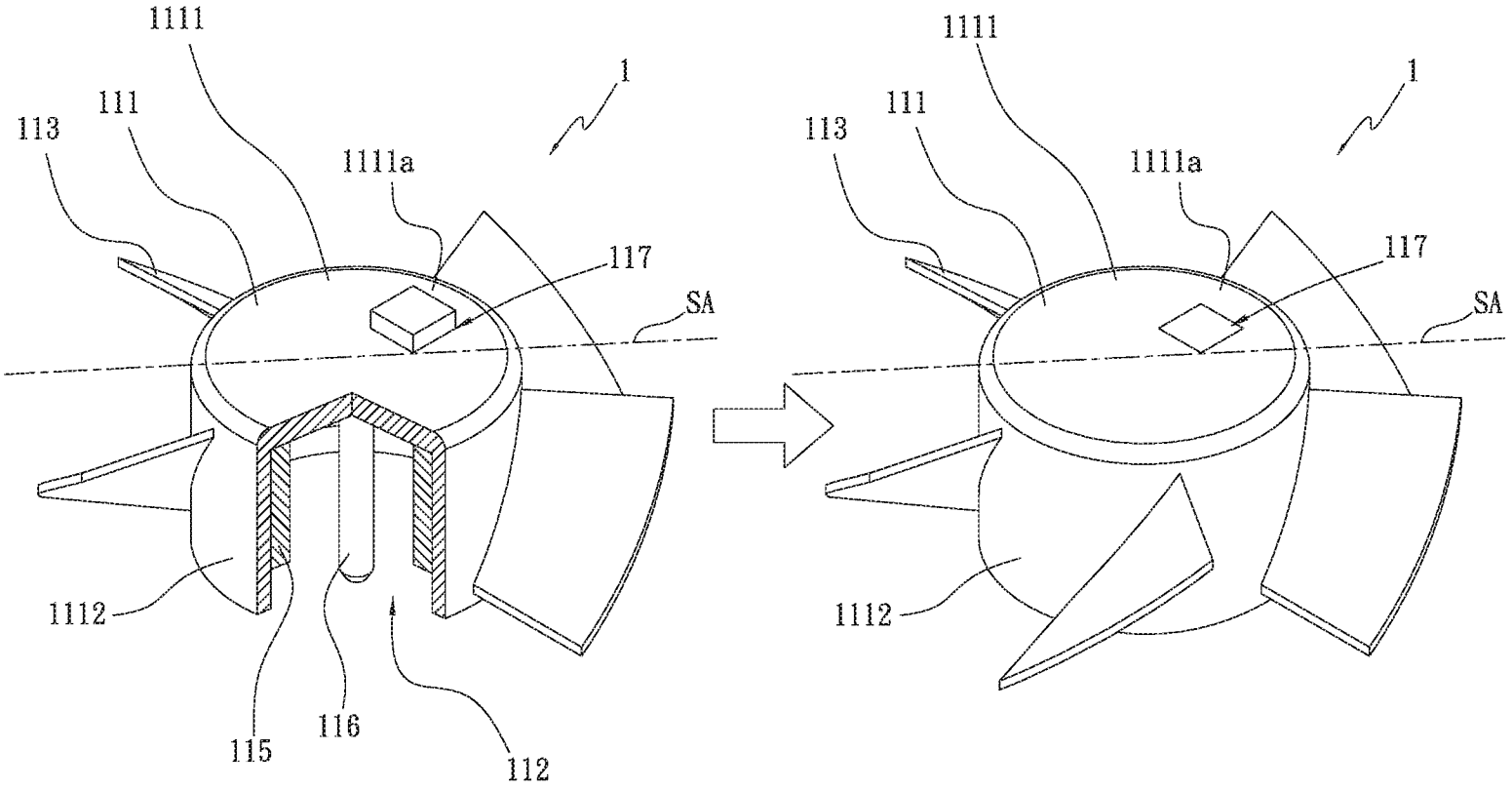
FIG. 1 is a perspective view of the unbalanced portion of the fan wheel according to the first embodiment of the present invention.

The present invention relates to a balance structure of a fan wheel. FIG. 1 is a perspective view of the unbalanced portion of the fan wheel according to the first embodiment of the present invention. As shown in FIG. 1, the balance structure of a fan wheel 1 of the present invention comprises a hub 111, a magnetic part 115, an axial shaft 116, and a plurality of blades 113. In the current embodiment, the hub 111 is made of plastic, but not limited to this. In other practices, the hub 111 can also be made of metal. The blades 113 are encirclingly disposed on the circumferential side of the hub 111. The hub 111 has a top wall 1111 connected to a sidewall 1112. One end of the sidewall 1112 is connected to the outer edge of the top wall 1111. The receiving space 112 is defined by the sidewall 1112 and the top wall 1111. The magnetic part 115 is a magnet received and disposed on an inner side of the sidewall 1112 of the receiving space 112. The axial shaft 116 is inserted in the receiving space 112, at the center of the inner side of the top wall 1111 of the hub 111. The unbalanced portion 117 for being removed is selectively disposed on the top wall 1111 or on the sidewall 1112; the unbalanced portion 117 is located on one side or on the other side of the symmetrical axis SA of the hub 111. The current embodiment, when in practice, uses an injection mold (e.g., a plastic injection mold; not shown) having an unbalanced portion 117 like a protruding part which is located on one side (or the other side) of the symmetrical axis SA of the hub 111 of the fan wheel 11 to be injected. Then, the above-mentioned unbalanced portion 117 is integrally injected and formed on the top wall 1111 or on the sidewall 1112 of the hub 111 of the fan wheel by means of the injection mold.

Please continue to refer to FIG. 1 which is a perspective view of the unbalanced portion of the fan wheel according to the first embodiment of the present invention. As shown in FIG. 1, the unbalanced portion 117 of the present invention is a protruding part and has a shape of square, for example. In the current embodiment, the unbalanced portion 117 is integrally injected and protruded on the external surface 1111*a* of the top wall 1111 of the hub 111 by means of the above-mentioned injection mold; the unbalanced portion 117 is located on one side or on the other side of the symmetrical axis SA of the hub 111. The external surface 1111*a* of the top wall 1111 of the hub 111 located on one side of the symmetrical axis SA of the hub 111 and the external surface 1111*a* of the top wall 1111 of the hub 111 located on the other side of the symmetrical axis SA of the hub 111 are not symmetrical to each other. That is, the external surfaces 1111*a* of the top wall 1111 of the hub 111 located on both sides of the symmetrical axis SA of the hub 111 indicate a non-symmetrical design in which the symmetrical axis SA of the hub 111 is a virtual line that is vertical to the surface of the sidewall 1112 and passes through the center of the hub 111.

Because the worker can know in advance the increase in weight, the structure type (e.g., a protruding part structure), and the shape (e.g., a square or others) of the unbalanced portion 117 on the hub 111 of the fan wheel to be set to be injected, the worker can directly remove the whole unbalanced portion 117 using a machining tool such as a drill bit or a milling cutter according to the increase in weight of the unbalanced portion 117 such that the fan wheel can be balanced quickly. For example, the worker knows, from the display screen of the injection mold machine (e.g., an LCD screen; not shown), that the increase in weight of the unbalanced portion 117 (as a protruding part, which is preset and injected) of the hub 111 of the fan wheel is 6.005 g. Then, the worker directly remove the whole protruding part (i.e., the unbalanced portion 117 which weighs 6.005 g) by means of the above-mentioned machining tool such that the weight of the fan wheel is balanced. In this way, the worker can complete the balancing process of the fan wheel (or the material-reducing balancing process of the fan wheel) at one time, which effectively reduces the working hours and accelerates the balancing process to meet the required vibration level.

Therefore, by means of the integrally-formed structure of the unbalanced portion 117 (e.g., the protruding part) on the hub 111 of the fan wheel, the unbalance amount of the whole injected-formed fan wheel certainly falls within the unbalanced portion 117, which lets the worker directly know the position to remove the unbalanced portion and the weight of the unbalanced portion 117 to be removed to effectively achieve the effect of quick balancing of the fan wheel and the cost reduction. Also, the number of balancing repetition can be effectively reduced.

Figure 2A:
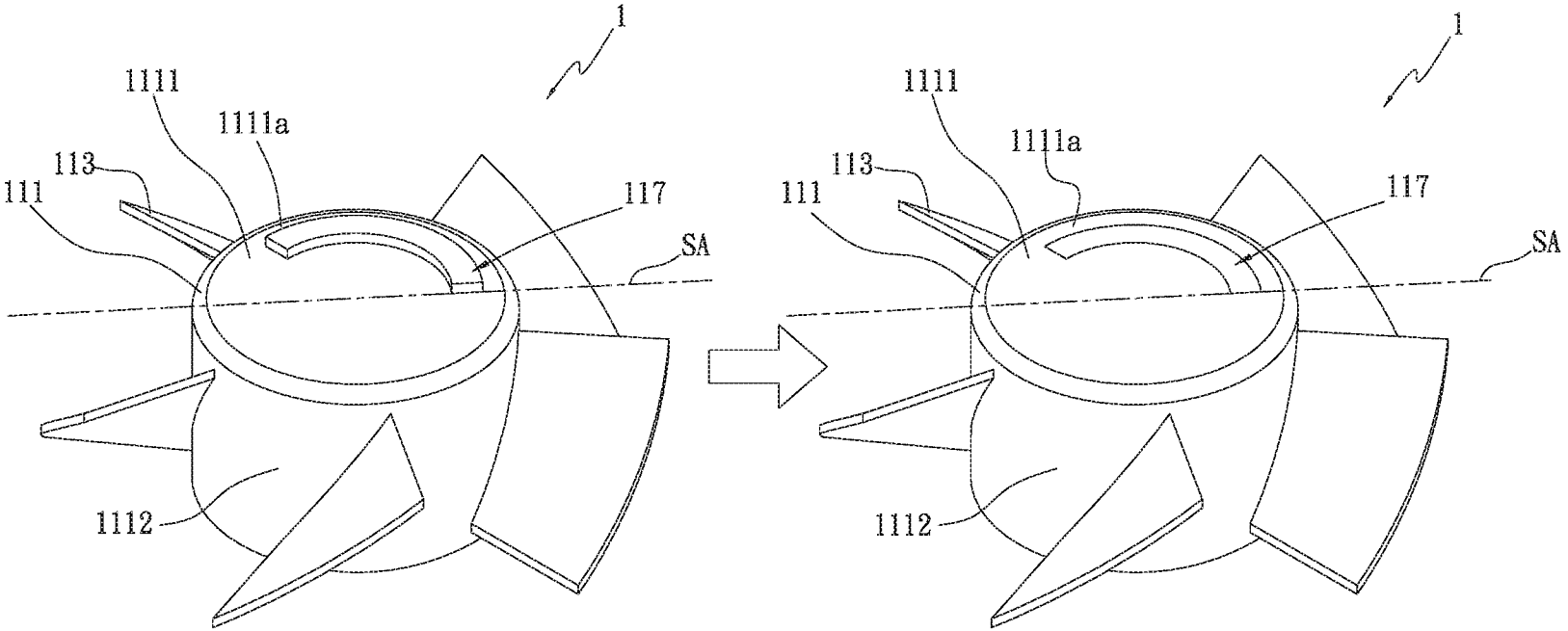
FIG. 2A is a perspective view of the unbalanced portion of the fan wheel according to the second embodiment of the present invention.
Figure 2B:
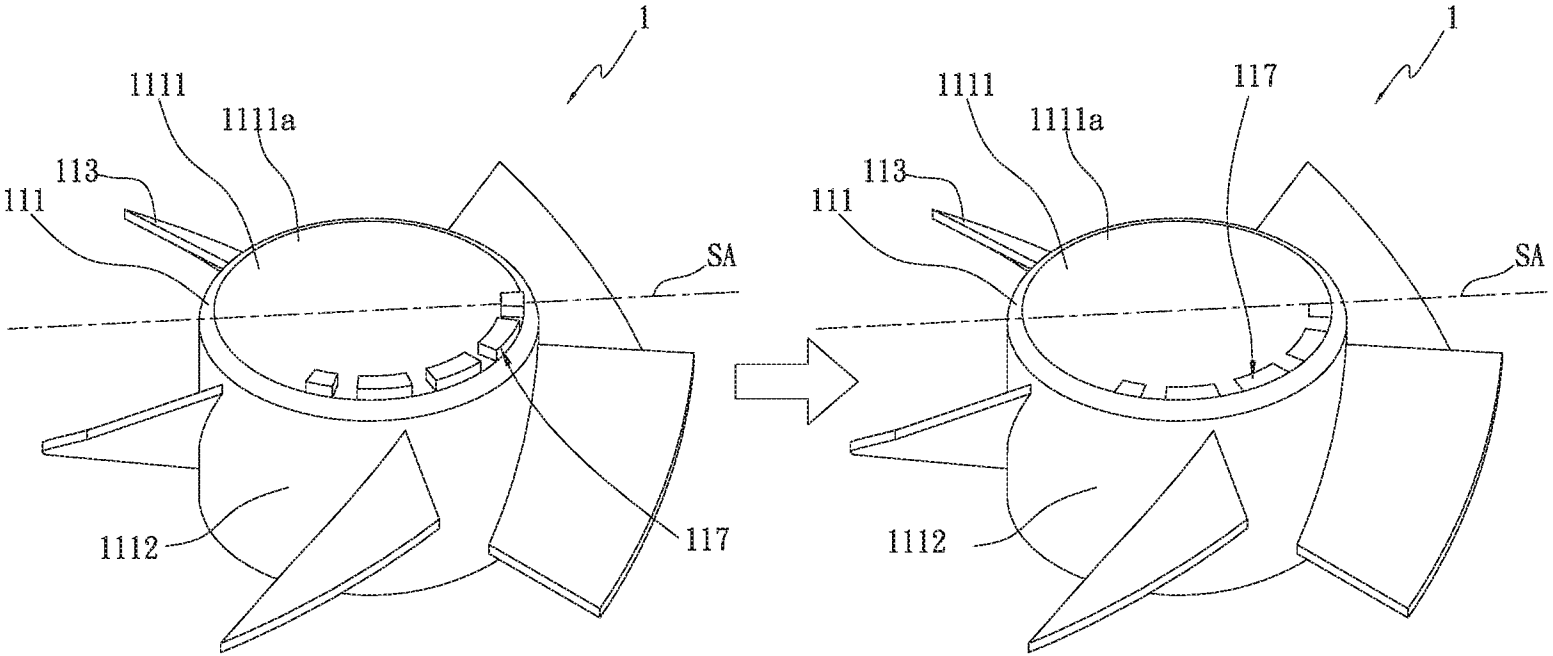
FIG. 2B is a perspective view of the unbalanced portion of the fan wheel according to the third embodiment of the present invention.
Figure 2C:
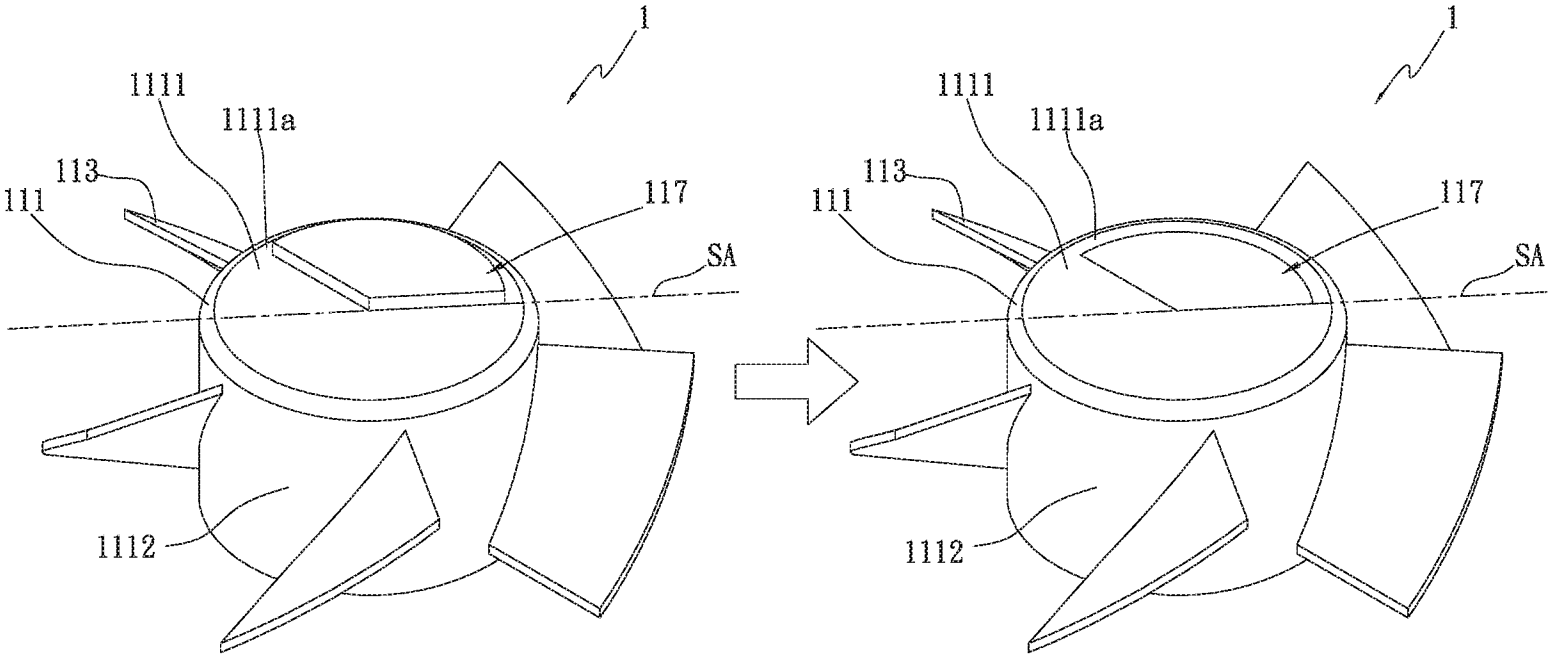
FIG. 2C is a perspective view of the unbalanced portion of the fan wheel according to the fourth embodiment of the present invention.

In the second embodiment, referring to FIG. 2A, the unbalanced portion 117 is a protruding part having a shape of half moon. In the third embodiment, referring to FIG. 2B, the unbalanced portion 117 is a protruding part having a shape of honeycomb. In the fourth embodiment, referring to FIG. 2C, the unbalanced portion 117 is a protruding part having a shape of circular sector.

Figure 2D:
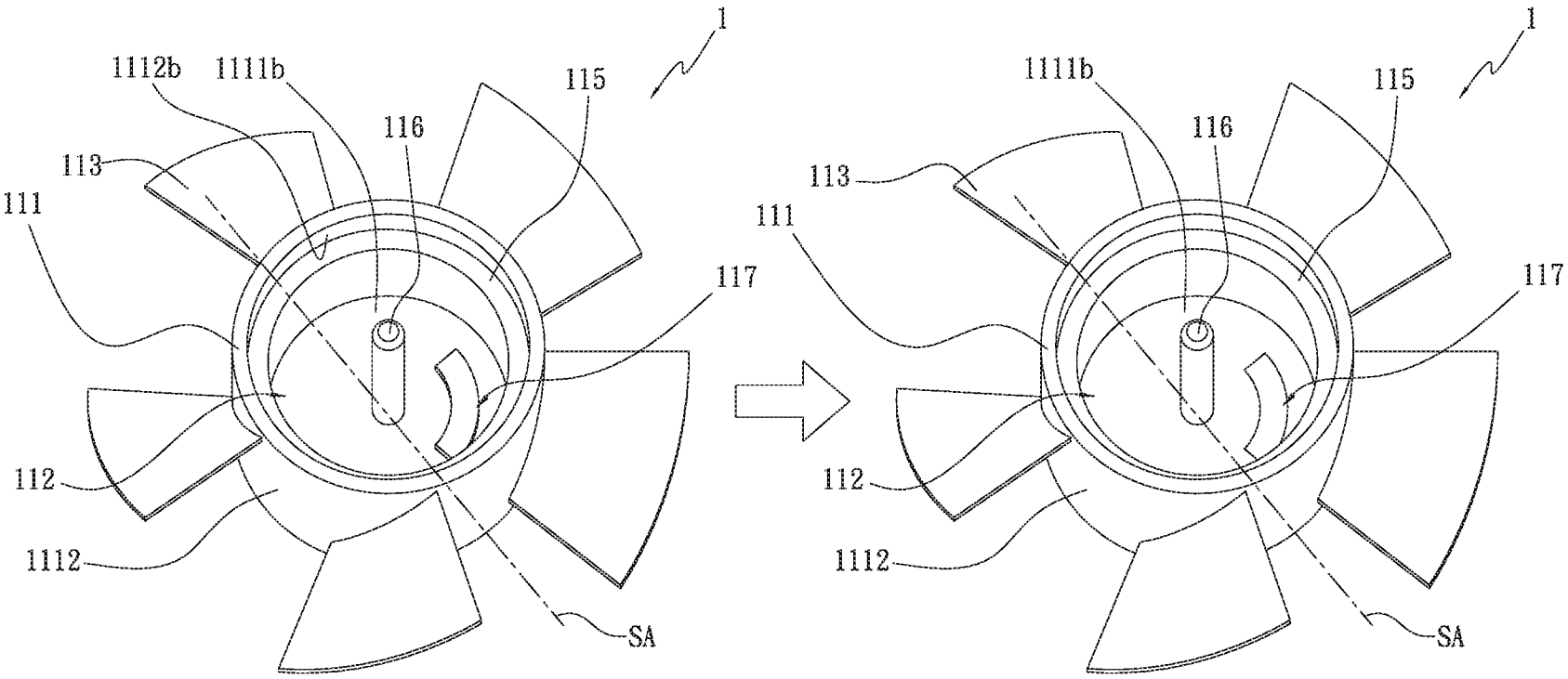
FIG. 2D is a perspective view of the unbalanced portion of the fan wheel according to the fifth embodiment of the present invention.

In the fifth embodiment, referring to FIG. 2D, the unbalanced portion 117 is changed to be a protruding part having a shape of half moon and is integrally formed and protruded on the internal surface 1111*b* of the top wall 1111 of the hub 111 for being removed, located on one side of the symmetrical axis SA of the hub 111. The internal surface 1111*b* of the top wall 1111 of the hub 111 located on one side of the symmetrical axis SA of the hub 111 and the internal surface 1111*b* of the top wall 1111 of the hub 111 located on the other side of the symmetrical axis SA of the hub 111 are not symmetrical to each other.

Figure 3:
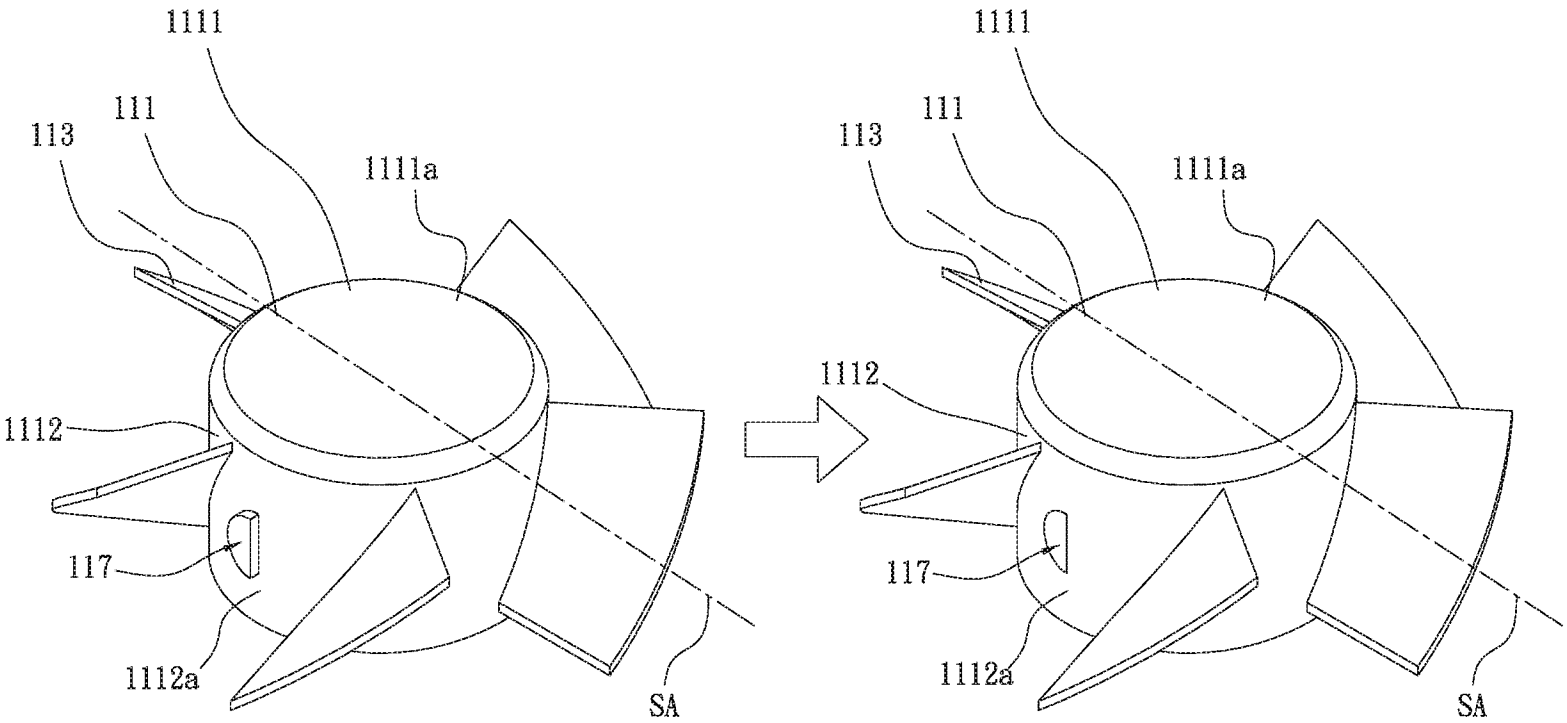
FIG. 3 is a perspective view of the unbalanced portion of the fan wheel according to the sixth embodiment of the present invention.

Please continue to refer to FIG. 3 which is a perspective view of the unbalanced portion of the fan wheel according to the sixth embodiment of the present invention. As shown in FIG. 3, the unbalanced portion 117 of the present invention is a protruding part having a shape of half moon and is integrally formed and protruded on the external surface 1112*a* of the sidewall 1112 of the hub 111 for being removed, located on one side of the symmetrical axis SA of the hub 111. The external surface 1112*a* of the sidewall 1112 of the hub 111 located on one side of the symmetrical axis SA of the hub 111 and the external surface 1112*a* of the sidewall 1112 of the hub 111 located on the other side of the symmetrical axis SA of the hub 111 are not symmetrical to each other. The symmetrical axis SA of the hub 111 is a virtual line that is vertical to the surface of the sidewall 1112 and passes through the center of the hub 111.

The balancing process of the fan wheel for the sixth embodiment is roughly identical to those for the first, second, third, fourth, and fifth embodiments and the identical portions are not described here again. In the current embodiment, the unbalanced portion 117 is protruded on the external surface 1112*a* of the sidewall 1112 of the hub 111, injected and integrally formed through the above-mentioned injection mold and then the whole unbalanced portion 117 is removed by a machining tool such as a drill bit or a milling cutter such that the fan wheel can be balanced quickly.

Figure 4:
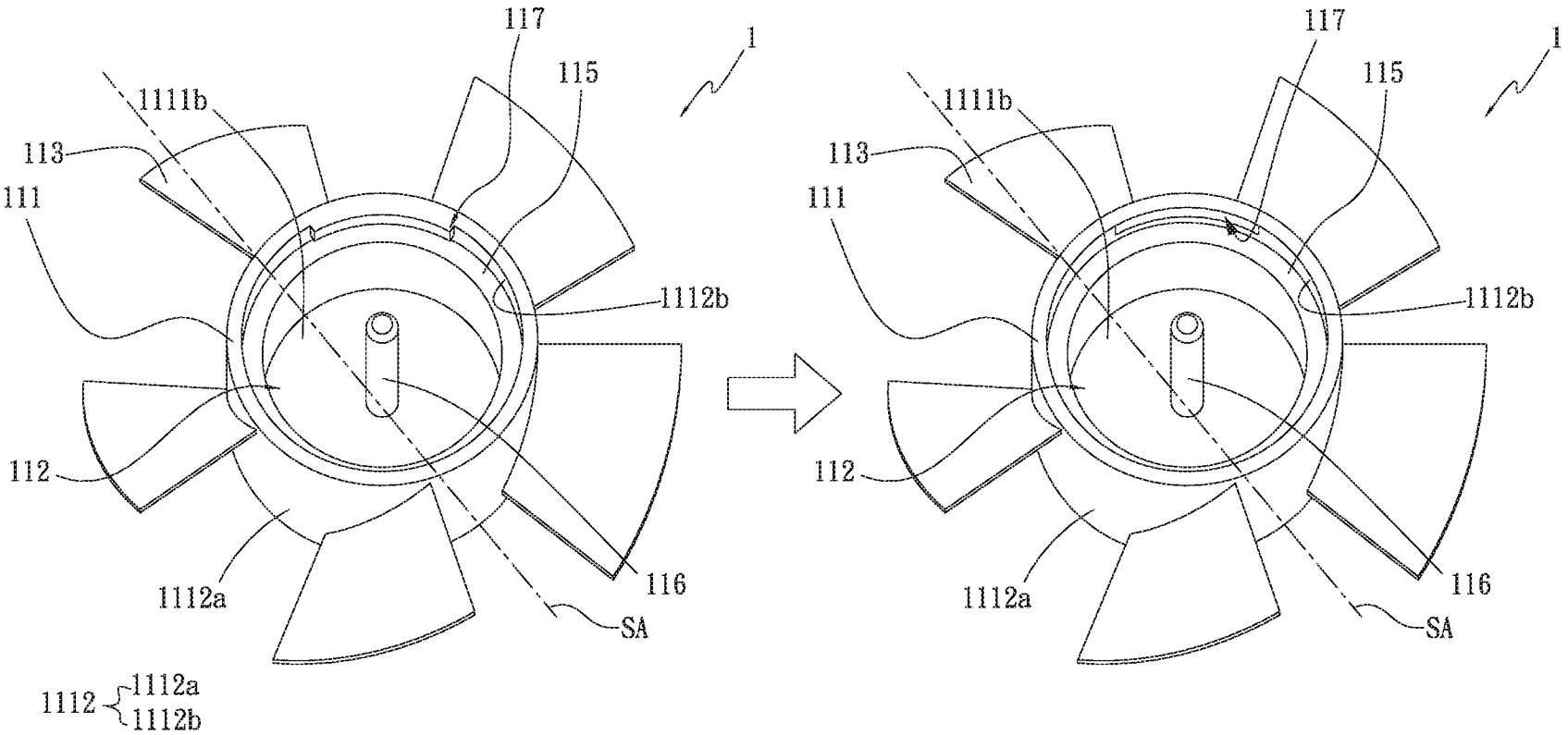
FIG. 4 is a perspective view of the unbalanced portion of the fan wheel according to the seventh embodiment of the present invention.

In the seventh embodiment, referring to FIG. 4, the unbalanced portion 117 is changed to be a protruding part shaped as a long strip and is integrally formed and protruded on the internal surface 1112*b* of the sidewall 1112 of the hub 111 for being removed, located on one side of the symmetrical axis SA of the hub 111. The internal surface 1112*b* of the sidewall 1112 of the hub 111 located on one side of the symmetrical axis SA of the hub 111 and the internal surface 1112*b* of the sidewall 1112 of the hub 111 located on the other side of the symmetrical axis SA of the hub 111 are not symmetrical to each other.

Moreover, the shape of the protruding part as the unbalanced portion 117 in the above-mentioned embodiments is not limited to the shapes mentioned above. In practice, the protruding part of the unbalanced portion 117 can be designed to have a shape of square, rectangle, circle, semicircle, half moon, circular sector, honeycomb, or one of other geometries.

What is claimed is:

1. A fan wheel comprising:

a hub having a top wall connected to a sidewall;

wherein a receiving space is defined by the top wall and the sidewall, wherein a magnetic part is received and disposed on an inner side of the sidewall of the receiving space, wherein an axial shaft is inserted to an inner side of the top wall of the hub;

a protruding unbalanced portion of a known weight integrally injected on the top wall or on the sidewall on one side of the hub with no protruding unbalanced portion disposed on another side of the hub; and a plurality of blades disposed on a circumferential side of the hub, wherein an overall unbalanced weight of the fan wheel with the protruding unbalanced portion is equal to the known weight of the protruding unbalanced portion.

2. The fan wheel according to claim 1, wherein the protruding unbalanced portion protrudes from an external surface of the top wall of the hub, wherein the external surface of the top wall of the hub located on the one side of the hub and the external surface of the top wall of the hub located on the other side of the hub are not symmetrical to each other.

3. The balance structure of a fan wheel according to claim 1, wherein the unbalanced portion is integrally formed and protruded on an internal surface of the top wall of the hub for being removed, wherein the internal surface of the top wall of the hub located on one side of the symmetrical axis of the hub and the internal surface of the top wall of the hub located on the other side of the symmetrical axis of the hub are not symmetrical to each other.

4. The balance structure of a fan wheel according to claim 1, wherein the unbalanced portion is integrally formed and protruded on an external surface of the sidewall of the hub for being removed, wherein the external surface of the sidewall of the hub located on one side of the symmetrical axis of the hub and the external surface of the sidewall of the hub located on the other side of the symmetrical axis of the hub are not symmetrical to each other.

5. The balance structure of a fan wheel according to claim 1, wherein the unbalanced portion is integrally formed and protruded on an internal surface of the sidewall of the hub for being removed, wherein the internal surface of the sidewall of the hub located on one side of the symmetrical axis of the hub and the internal surface of the sidewall of the hub located on the other side of the symmetrical axis of the hub are not symmetrical to each other.

6. The fan wheel according to claim 1, wherein the protruding unbalanced portion has a shape of square, rectangle, circle, half moon, semicircle, honeycomb, or circular sector.

* * * * *